United States Patent [19]

Steiner et al.

[11] 4,324,974

[45] Apr. 13, 1982

[54] HEATING ELEMENT ASSEMBLY WITH A PTC ELECTRIC HEATING ELEMENT

[75] Inventors: Herbert Steiner, Traunstorf; Johann Magg, St. Georgen, both of Fed. Rep. of Germany

[73] Assignee: Bosch-Siemens Hausgeräge GmbH, Stuttgart, Fed. Rep. of Germany

[21] Appl. No.: 66,339

[22] Filed: Aug. 14, 1979

[30] Foreign Application Priority Data

Aug. 16, 1978 [DE] Fed. Rep. of Germany ..... 2835742

[51] Int. Cl.[3] ..... H05B 3/10

[52] U.S. Cl. ..... 219/553; 219/439; 219/441; 219/523; 219/540; 219/541; 338/22 R

[58] Field of Search ..... 219/432, 433, 438, 439, 219/441, 552, 462, 540, 541, 544, 553, 328, 505, 528; 338/22 R, 22 SD

[56] References Cited

U.S. PATENT DOCUMENTS

| | | | |
|---|---|---|---|
| 3,375,774 | 4/1968 | Fujimura et al. | 99/281 |
| 3,577,835 | 12/1970 | Short | 338/22 SD X |
| 3,748,439 | 7/1973 | Ting et al. | 338/22 R |
| 3,835,434 | 9/1974 | Kahn | 338/22 R |
| 3,996,447 | 12/1976 | Bouffard | 219/541 |
| 4,104,509 | 8/1978 | Van Bokestal et al. | 219/544 |
| 4,147,927 | 4/1979 | Pirotte | 219/541 |
| 4,177,375 | 12/1979 | Meixner | 219/441 |

*Primary Examiner*—Volodymyr Y. Mayewsky
*Attorney, Agent, or Firm*—Herbert L. Lerner

[57] ABSTRACT

Heating device with a heating element of a material with positive temperature coefficient, of which two opposite sides are contacted by planar electrodes and give off the heat produced through the electrodes and planar sheets of insulating material covering the same to two heat-absorbing surfaces of a heater. The sheets of insulating material are coated on their side facing the heating element over a large area with a solder and are soldered to the electrodes. This insures permanent good heat transfer between the electrodes and the insulating material covering them. The firmly joining together of the heating element and the sheets of insulating material to form a structural unit facilitates the assembly, i.e., the installation of the heating device.

7 Claims, 2 Drawing Figures

HEATING ELEMENT ASSEMBLY WITH A PTC ELECTRIC HEATING ELEMENT

BACKGROUND OF THE INVENTION

1. Field of the Invention

The invention relates to a heating device with a heating element of a material with positive temperature coefficent, of which two opposite sides are contacted by planar electrodes and give off the heat produced through the electrodes and planar sheets of insulating material covering the same to two heat-absorbing surfaces of a heater.

2. Description of the Prior Art

Such heating devices have been proposed in German Patent Application No. P 27 43 880 (corresponding allowed U.S. application Ser. No. 946,634 now U.S. Pat. No. 4,177,375) and German Petty Patent Application No. G 77 30233. There, the sheets of insulating material are placed on the electrodes and are pressed by a press fit onto the electrodes in the assembled condition in order to achieve good heat transfer to the sheets of insulating material. This design has the disadvantage that in the course of time the press fit becomes loose and the heat transfer is impaired.

SUMMARY OF THE INVENTION

An object of the invention is to provide a heating device with a PTC heating element which ensures permanent good heat transfer between the electrodes and the insulating material covering them.

With the foregoing and other objects in view, there is provided in accordance with the invention a heating device with a heating element of a material with positive temperature coefficient, of which two opposite sides are contacted by planar electrodes and give off the heat produced through the electrodes and planar sheets of insulating material covering the same to two heat-absorbing surfaces of a heater, the improvement comprising that the sheets of insulating material are coated on their side facing the heating element over a large area with a solder and are soldered to the electrodes.

Other features which are considered as characteristic for the invention are set forth in the appended claims.

Although the invention is illustrated and described herein as embodied in heating device with a heating element of a material with positive temperature coefficient, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

In accordance with the invention, the sheets of insulating material are coated with solder on their side facing the heating element and are soldered to the electrodes. Thereby, the heating element and the sheets of insulating material are firmly joined together to form a structural unit, which also facilitates the assembly, i.e., the installation of the heating device.

The heating element preferably has the shape of a disc and is contacted on its flat sides by the electrodes, whereby large heat transfer surfaces are available. The solder can then be vapor-deposited on the plates of insulating material, but various other coating methods are known which establish an intimate, pore-filling bond between the plates and the solder. Aluminum serves advantageously as solder, since customarily the electrodes of the heating element consist of aluminum.

According to a further advantageous embodiment, the sides facing away from the heating element of the insulating material plates are also coated with solder and are soldered to the contact surfaces of the heater or a closure plate inserted therein, so as to also have optimum heat transfer on that side.

In the following, the invention will be explained in greater detail by means of embodiment examples with reference to the schematic drawings.

Figure 1:
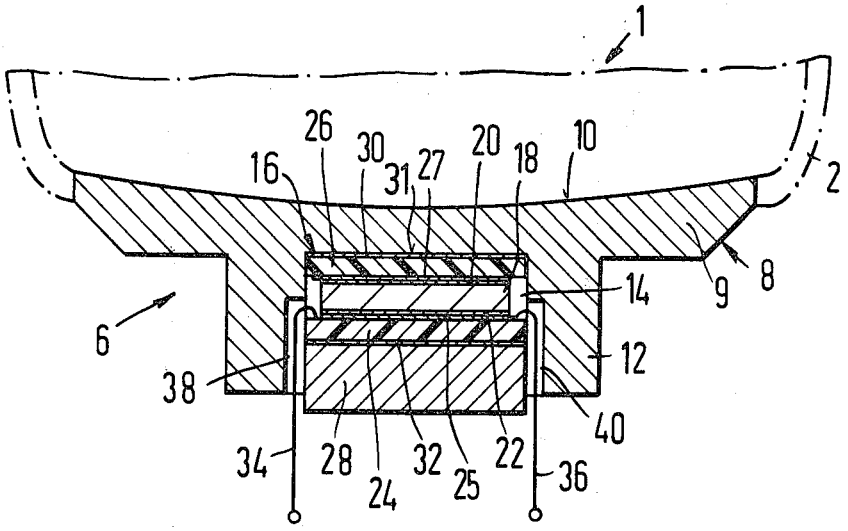
FIG. 1 shows a vertical cross section through a heating device according to the invention, in the bottom of a water dish of an electric egg cooker.

The water dish 1, shown in FIG. 1, of an electric egg cooker shows a plastic dish 2, into which a heating device 6 is tightly inserted as the bottom. The heating device 6 comprises a heater 8 of a highly heat-conducting material such as an aluminum die casting, with an upper bottom plate 9 which gives off the electrically generated heat at its surface 10 to the water to be heated, and an extension 12 extending downward therefrom with a recess 14 on the bottom side, which accommodates a heating element assembly 16.

Figure 2:
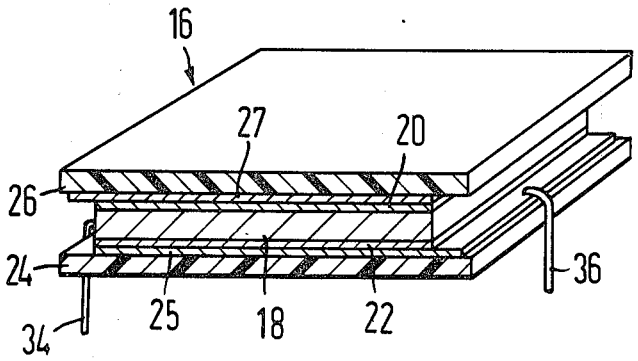
FIG. 2 is a perspective view of the heating element assembly partly in a cross section, corresponding to FIG. 1.

The heating element assembly 16 shown enlarged in FIG. 2 comprises a disc-shaped heating element 18 of a material with positive temperature coefficient, the two flat sides of which are covered in the usual manner with thin electrodes 20 and 22, for instance, of aluminum. As electrical insulation for the metallic heating device 6, the electrodes 22 and 20 are covered with plates of insulating material 24 and 26, for instance, of Be-oxide or Al-oxide extending beyond the edges of the heating element 18. The plates of insulating material 24 and 26 are coated on their side facing the heating element with solder layers 25 and 27, respectively, for instance, with vapor-deposited aluminum and are soldered to the electrodes 22 and 20 of the heating element 18. The solder coats a large area of the face, preferably more than 50% of the area of the face, desirably more than 80%. The heating element 18 and the plates of insulating material 24 and 26 are firmly joined together to form the heating element assembly 16, which rests on the bottom surface 31 of the recess 14 of the heater 8 with interposition of a ductile metal layer 30, for instance, of Pb, Pb-In, or In. A closure plate 28, which is covered on its top side likewise with a ductile metal layer 32 is pressed into the recess below the heating element assembly 16. The ductile metal layers 30 and 32 practically give way when pressed-in and distribute the pressure more uniformly and fill unevenesses of the surfaces, which improves the heat transfer from the insulating material plates 24 and 26 to the heater 8 and the closure plate 28.

Soldering the coating insulating material plates 24 and 26 to the electrodes 22 and 20 of the heating element 18 ensures good heat transfer from the latter to the insulating material plates and facilitates the assembly of the entire heating device 6. The heating element 18 is reliably secured against lateral shifts and contacts with the side walls of the recess 14.

Electric leads 34 and 36 are soldered at the solder coatings 25 and 27 of the end sections of the insulating material plates 24 and 26 extending beyond the heating element 18 and are brought to the outside through lateral slots 38 and 40 in the recess 14.

The ductile metal layers 30 and 32 can be replaced by solder coatings on the back sides of the insulating material plates 24 and 26, which are soldered after assembly to the heater 8 and the closure plate 28, thereby further improving the heat transfer. Preferably, a water dish, i.e., a heating element of gun metal or another copper alloy is used here, in order to avoid difficulties in making the solder joint. Also the electrodes of the heating element can then consist to advantage of copper, and the solder can be a silver solder or another solder melting at a low enough temperature.

There are claimed:

1. A heating element assembly for insertion in a recess in a highly heat conducting material to thereby transfer heat from the inserted heating element assembly through the heat-conducting surfaces of the recess into the heat conducting material, which comprises an electric heating element of a material with positive temperature coefficient having planar opposite sides, planar electrodes which are electrically and thermally conductive contacting the two opposite sides, planar sheets of thermally conductive and electrically non-conductive insulating material covering the two opposite sides, the combination therewith of said sheets of insulating material coated on their side facing the heating element over a large area with a solder and soldered to the electrodes, said solder being electrically and thermally conductive and having electric leads and said planar sheets of insulating material extending beyond the edges of said heating element.

2. The heating element assembly according to claim 1, wherein the heating element is disc-shaped and is contacted on its flat sides by the electrodes.

3. The heating element assembly according to claim 1 or claim 2, wherein the solder is vapor-deposited on the sheets of insulating material.

4. The heating element assembly according to claim 1, wherein aluminum serves as the solder.

5. The heating element assembly according to claim 1, or claim 2 or claim 4, wherein the insulating material consists of aluminum oxide.

6. The heating element assembly according to claim 1, wherein the insulating material plates are coated on the sides facing away from the heating element with solder and are soldered to said heat conducting surfaces of the recess.

7. The heating element assembly according to claim 1, wherein the insulating material plates are coated on the sides facing away from the heating element with solder and are soldered to heat conducting surfaces of the of the recess.

* * * * *